US011007667B2

(12) United States Patent
Meilin et al.

(10) Patent No.: US 11,007,667 B2
(45) Date of Patent: May 18, 2021

(54) SYSTEMS AND METHODS FOR PERFORATING FLEXIBLE FILMS, AND RELATED PUNCHING TOOLS

(71) Applicant: Kulicke and Soffa Industries, Inc., Fort Washington, PA (US)

(72) Inventors: Haim Meilin, Kfar Veradim (IL); Limor Zuri, Haifa (IL); Aime Elkouby, Haifa (IL)

(73) Assignee: Kulicke and Soffa Industries, Inc., Fort Washington, PA (US)

( * ) Notice: Subject to any disclaimer, the term of this patent is extended or adjusted under 35 U.S.C. 154(b) by 0 days.

(21) Appl. No.: 16/541,302

(22) Filed: Aug. 15, 2019

(65) Prior Publication Data

US 2020/0055210 A1 Feb. 20, 2020

Related U.S. Application Data

(60) Provisional application No. 62/719,920, filed on Aug. 20, 2018.

(51) Int. Cl.

| | |
|---|---|
| ***B26F 1/14*** | (2006.01) |
| ***B65H 35/00*** | (2006.01) |
| ***B26D 7/01*** | (2006.01) |

(52) U.S. Cl.

CPC ..... *B26F 1/14* (2013.01); *B26D 7/01* (2013.01); *B65H 35/0073* (2013.01)

(58) Field of Classification Search

CPC ..... B26F 1/14; B26D 7/01; B65H 35/0073

See application file for complete search history.

(56) References Cited

U.S. PATENT DOCUMENTS

| | | | | |
|---|---|---|---|---|
| 5,068,513 | A * | 11/1991 | Gangemi | B26F 3/004 219/121.67 |
| 5,214,991 | A * | 6/1993 | Shimizu | B21D 28/24 83/168 |
| 6,766,723 | B2 * | 7/2004 | Yasoda | B26F 1/04 83/405 |
| 9,511,505 | B2 | 12/2016 | Ohnishi et al. | |
| 2007/0295178 | A1 | 12/2007 | Tsuji et al. | |
| 2010/0319503 | A1 | 12/2010 | Bakker et al. | |
| 2014/0260438 | A1 * | 9/2014 | Matsumura | B26D 7/02 69/2 |

FOREIGN PATENT DOCUMENTS

| | | | |
|---|---|---|---|
| JP | 5528614 | B1 | 6/2014 |
| JP | 2017-019028 | A | 1/2017 |
| KR | 10-162210 | B1 | 5/2016 |

OTHER PUBLICATIONS

International Search Report dated Dec. 4, 2019 for International Patent Application No. PCT/US2019/046625.

* cited by examiner

*Primary Examiner* — Omar Flores Sanchez

(74) *Attorney, Agent, or Firm* — Christopher M. Spletzer, Sr.

(57) ABSTRACT

A system for forming apertures in a flexible film is provided. The system includes a punching tool for forming apertures in a flexible film. The punching tool defines a through hole therethrough. The system also includes a support plate. The punching tool is configured to press the flexible film against the support plate to form the apertures.

24 Claims, 9 Drawing Sheets

SYSTEMS AND METHODS FOR PERFORATING FLEXIBLE FILMS, AND RELATED PUNCHING TOOLS

CROSS-REFERENCE TO RELATED APPLICATION

This application claims the benefit of U.S. Provisional Application No. 62/719,920, filed Aug. 20, 2018, the content of which is incorporated herein by reference.

FIELD

The invention relates to the formation of perforations in flexible films, and more particularly, to improved systems and methods of forming perforations in such flexible films.

BACKGROUND

Flexible films are often used in packaging, for example, in the food packaging industry (e.g., fruit packaging, vegetable packaging, etc.). Perforations/apertures are sometimes formed in such flexible films. Such perforations may be formed, for example, using laser systems and needle based systems. Conventional perforation systems tend to suffer from various deficiencies such as, for example: high cost of ownership; high cost of use; poor uniformity of perforations; poorly shaped perforations; etc.

Thus, it would be desirable to provide improved systems and methods of forming perforations/apertures in a flexible film.

SUMMARY

According to an exemplary embodiment of the invention, a system for forming apertures in a flexible film is provided. The system includes a punching tool for forming apertures in a flexible film. The punching tool defines a through hole therethrough. The system also includes a support plate. The punching tool is configured to press the flexible film against the support plate to form the apertures.

According to another exemplary embodiment of the invention, a method of forming an aperture in a flexible film is provided. The method includes the steps of: providing a support plate; and pressing a flexible film against the support plate using a punching tool for forming the aperture, the punching tool defining a through hole therethrough.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity.

DETAILED DESCRIPTION

Figure 1B:
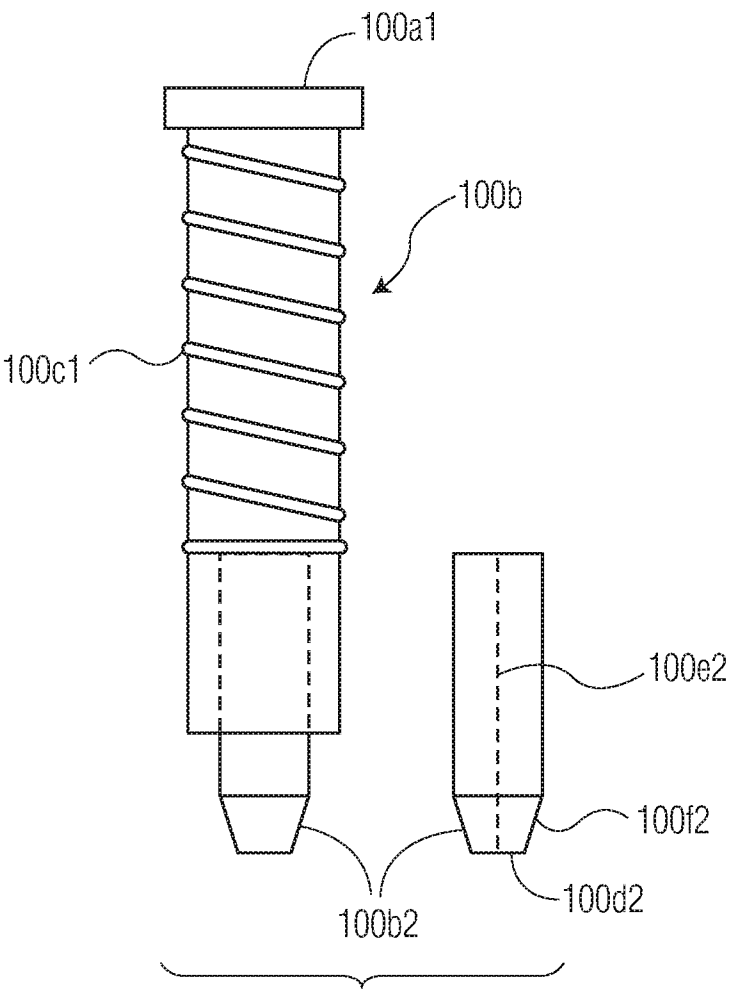
FIGS. 1A-1B are block diagrams of two punching members, including corresponding punching tools, in accordance with exemplary embodiments of the invention.
Figure 1A:
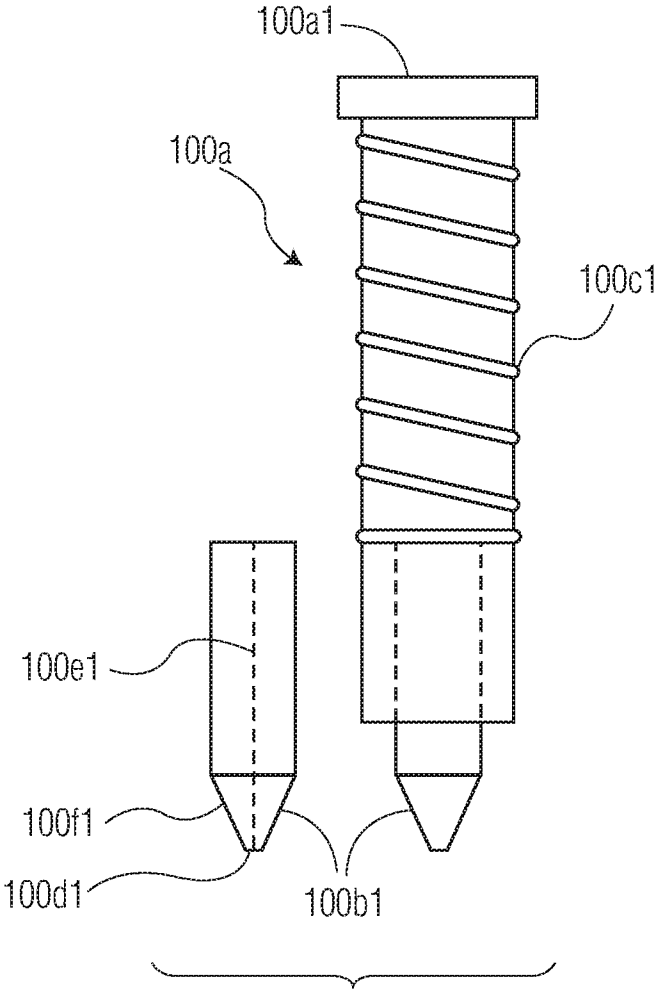

FIGS. 1A-1B illustrate punching members 100*a*, 100*b*. Each of punching members 100*a*, 100*b* includes a sleeve 100*a*1 (e.g., a metal sleeve, etc.). A punching tool 100*b*1, 100*b*2 is inserted into sleeve 100*a*1. For example, punching tools 100*b*1, 100*b*2 are held in their respective sleeve 100*a*1 using an adhesive, a fastener (e.g., a screw, bolt, etc.), or holding mechanism or method. A spring 100*c*1 is provided around a portion of each of the sleeves 100*a*1. It is noteworthy that punching members 100*a*, 100*b* are different from each other because they include different punching tools 100*b*1, 100*b*2. Exemplary punching tools may be formed from a ceramic material (e.g., an alumina material, a zirconia toughened alumina material, a ruby material, a silicon nitride material, etc.).

Punching tools 100*b*1, 100*b*2 each define a through hole 100*e*1, 100*e*2 extending from (i) a top of the punching tool (where the top of the tool is engaged in the sleeve 100*a*1) to (ii) a working tip 100*d*1, 100*d*2 of the respective punching tool 100*b*1, 100*b*2. Punching tools in accordance with the invention may be ground or otherwise formed to have a desired shape, particularly in the area of the working tip. As shown in the examples provided in FIGS. 1A-1B, the punching tools 100*b*1, 100*b*2 are cylindrical in shape, and include a tapered portion 100*f*1, 100*f*2 terminating at a working tip 100*d*1, 100*d*2, and each define a respective through hole 100*e*1, 100*e*2. A desirable aspect of the invention is that punching tools may have different features, for example, different working tip designs. FIGS. 1A-1B illustrate that working tip 100*d*1 of punching tool 100*b*1 is different from working tip 100*d*2 of punching tool 100*b*2. In a specific example, the outer diameter of the cylindrical body of the punching tools may be the same, but the working tip may be different.

Figure 2:
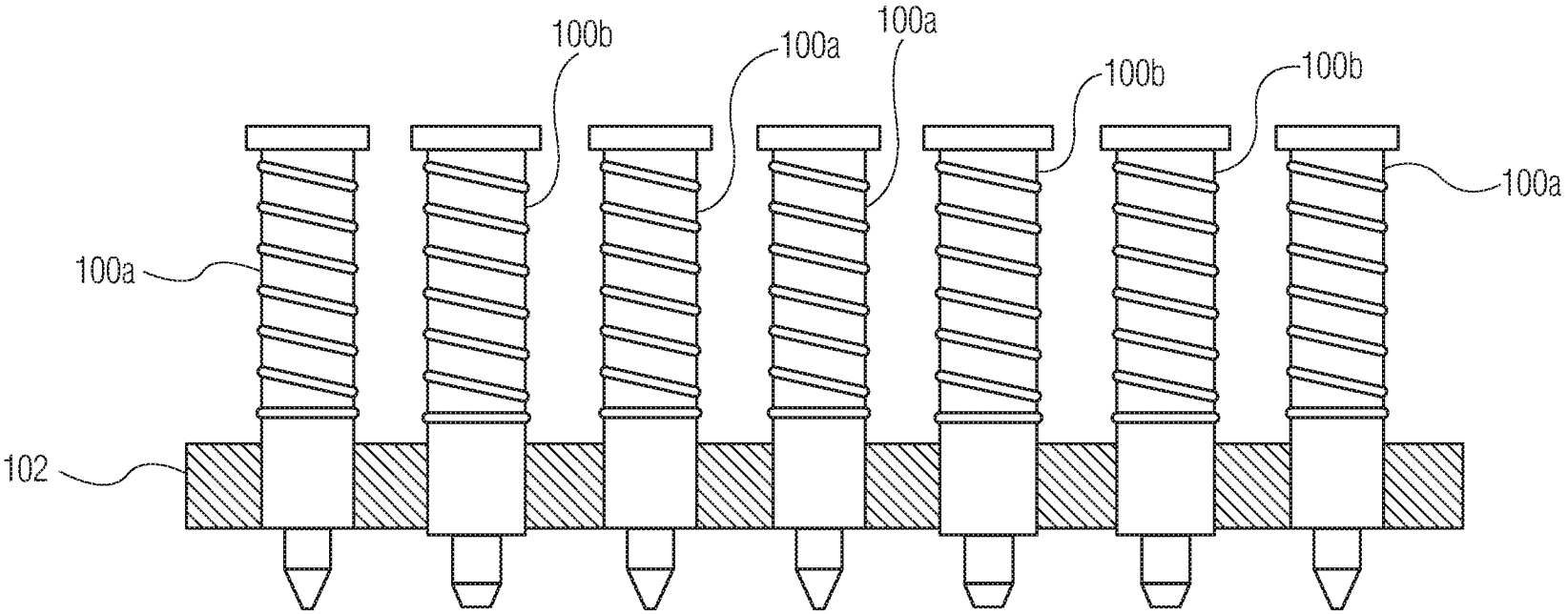
FIG. 2 is a block diagram of an array of punching members in accordance with an exemplary embodiment of the invention.

FIG. 2 illustrates a plurality of punching members 100*a*, 100*b* held by a tool holder 102. Any number of punching members 100*a*, 100*b* (including corresponding punching tools 100*b*1, 100*b*2), in any number of rows, may be held by tool holder 102. A given tool holder 102 may carry punching members 100*a*, 100*b* (or other punching members) having different styles or models of punching tools 100*b*1, 100*b*2.

Figure 3:
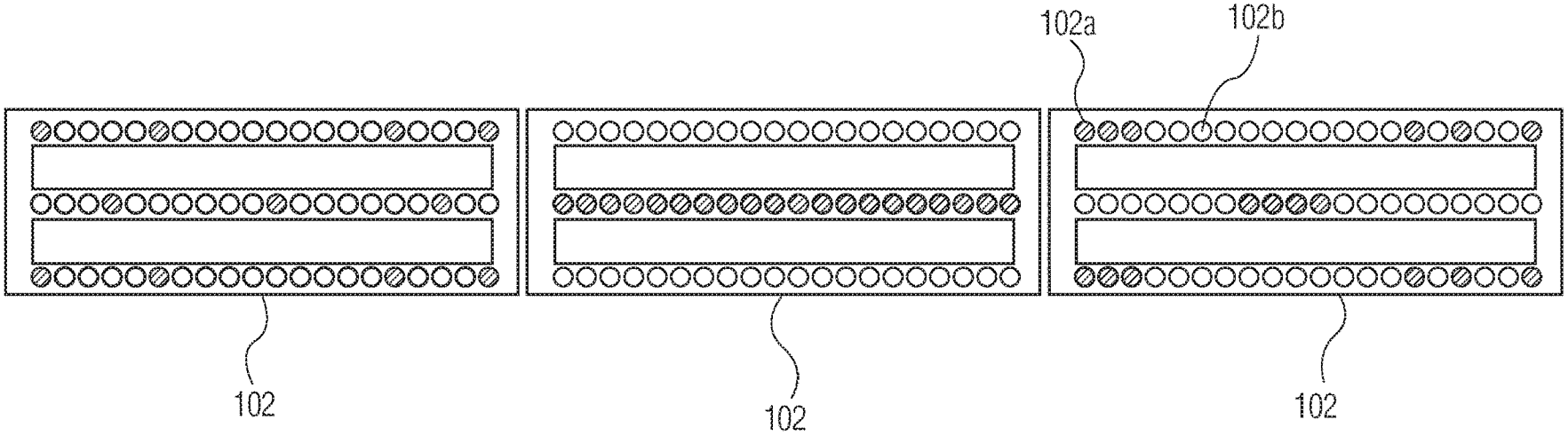
FIG. 3 is a top view of three tool holders including respective arrays of punching members in accordance with exemplary embodiments of the invention.

FIG. 3 illustrates three (3) different tool holders 102. Each of the tool holders 102 has the same design, with the same number of rows, and the same number of receivers (e.g., holes) for receiving punching members (e.g., punching members 100*a*, 100*b*, or other punching members). Each of the three (3) tool holders 102 shown in FIG. 3 holds different numbers of punching members in different locations. As shown in FIG. 3, an empty receiver in tool holder 102 is shown as hole 102*b*, whereas a filled receiver (e.g., filled with a punching member) in tool holder 102 is shown as filled hole 102*a*.

FIGS. 4A-4B and 5A-5B illustrate respective example systems 10*a*, 10*b* configured to form perforations in a flexible film 120. Systems 10*a*, 10*b* each include a feed system for feeding a flexible film 120. In the examples shown, the feed systems each include a source spool 116 that provides the flexible film 120 for processing (e.g., perforating) using respective system 10*a*, 10*b*. The feed systems also include a downstream spool 118 configured to receive the flexible film 120 after perforation. Systems 10*a*, 10*b* also each include a support plate 104. The punching tools (e.g., see punching tools 100*b*1, 100*b*2 in FIGS. 1A-1B) are configured to press flexible film 120 against support plate 104 to form the apertures.

Systems 10*a*, 10*b* also include: a tool holder 102 carrying a plurality of punching members (including corresponding punching tools); a striking tool 106 (including a plurality of striking members 106*a* being aligned to strike against a corresponding one of the plurality of punching tools (e.g., punching tools 100*b*1, 100*b*2, or other punching tools) through contact with the corresponding punching sleeve 100*a*1) configured to strike against the punching tool (through the punching sleeve 100*a*1) such that each punching tool presses the flexible film 120 against support plate 104 to form the apertures (e.g., see aperture 120*a* in FIGS. 7B-7C); and a holding plate 108 for holding flexible film 120 against support plate 104. Holding plate 108 defines a plurality of holes through which working tips (e.g., see working tips 100*d*1, 100*d*2 in FIGS. 1A-1B) of the punching tools extends during pressing.

Systems 10*a*, 10*b* also include (illustrated in block diagram form): a control system 400 for controlling operation of system 10*a*, 10*b* including controlling the punching tool 100*b*1, 100*b*2 pressing the flexible film 120 against the support plate 104 to form the apertures 120*a*; an inspection system 402 (e.g., including a camera and/or other imaging elements, and image processing tools) for inspecting the apertures 120*a* formed using the punching tool 100*b*1, 100*b*2; and a cleaning system 404 for collecting cut portions of the flexible film 120 caused by forming the apertures 120*a*.

Figure 4A:
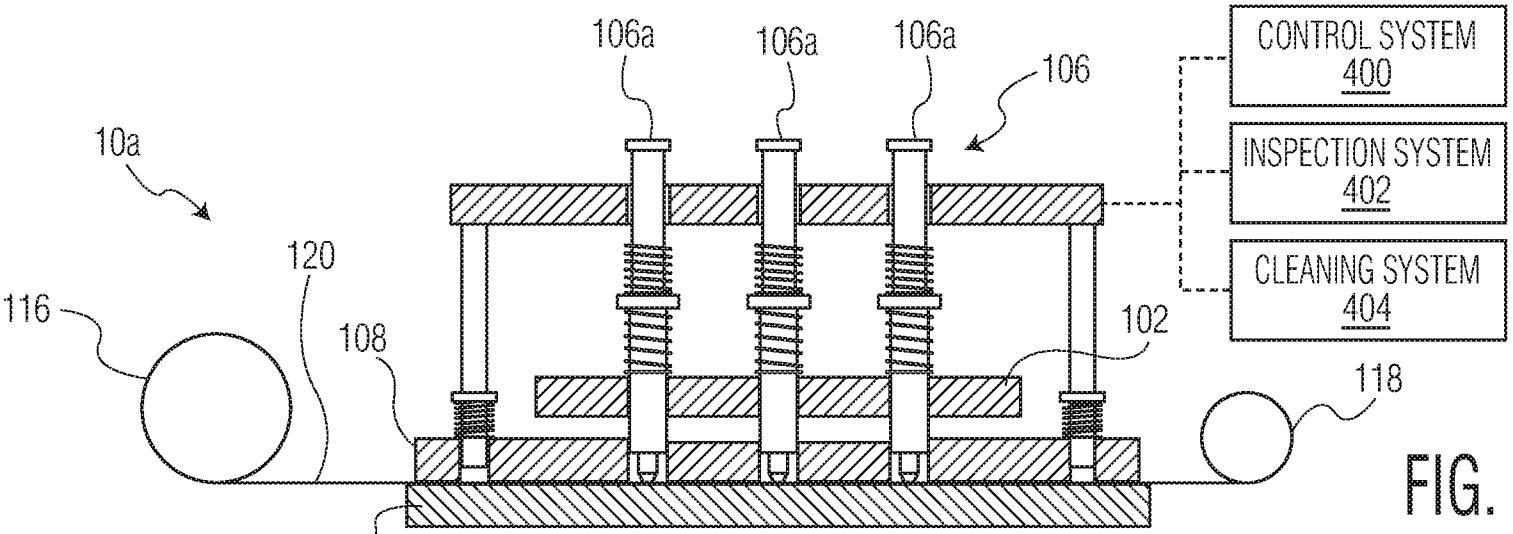
FIGS. 4A-4B are side, and top, block diagram views of a system for forming perforations/apertures in a flexible film in accordance with an exemplary embodiment of the invention.
Figure 4B:
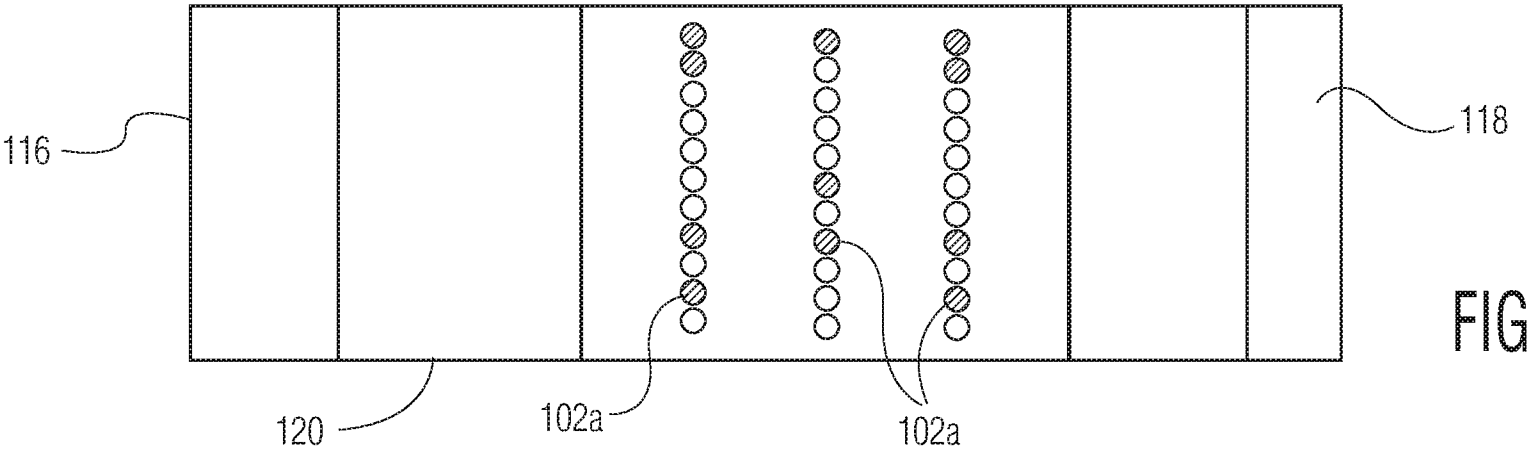
Figure 5A:
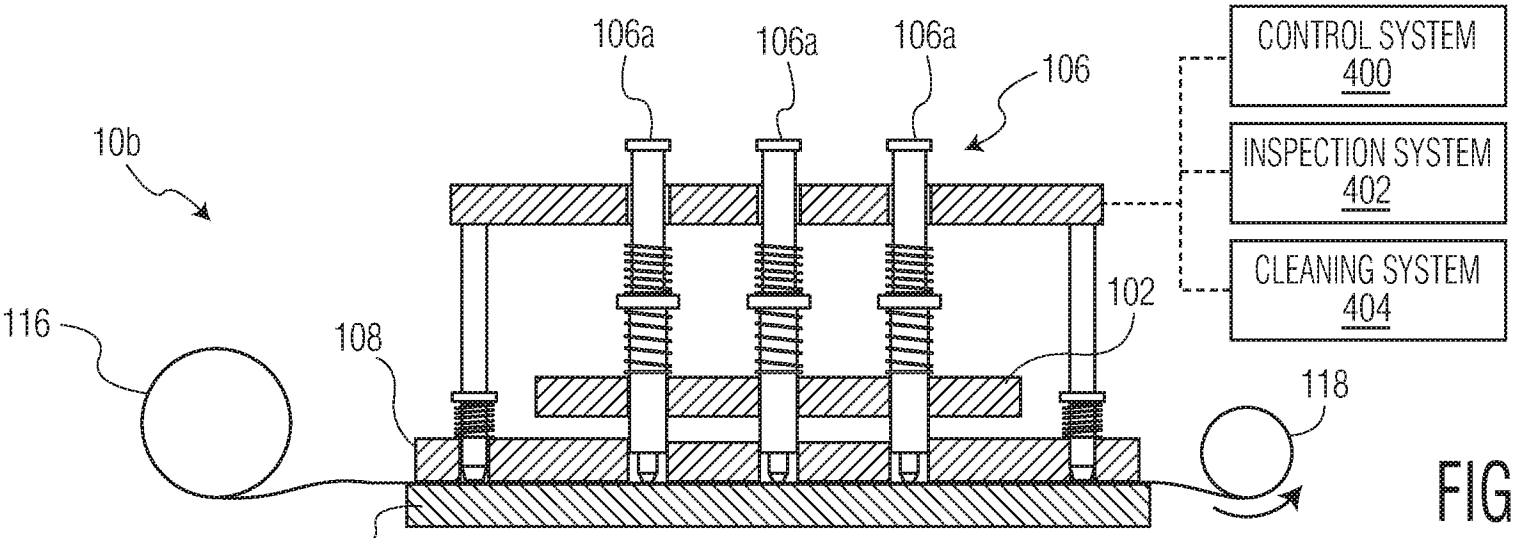
FIGS. 5A-5B are side, and top, block diagram views of another system for forming perforations/apertures in a flexible film in accordance with another exemplary embodiment of the invention.
Figure 5B:
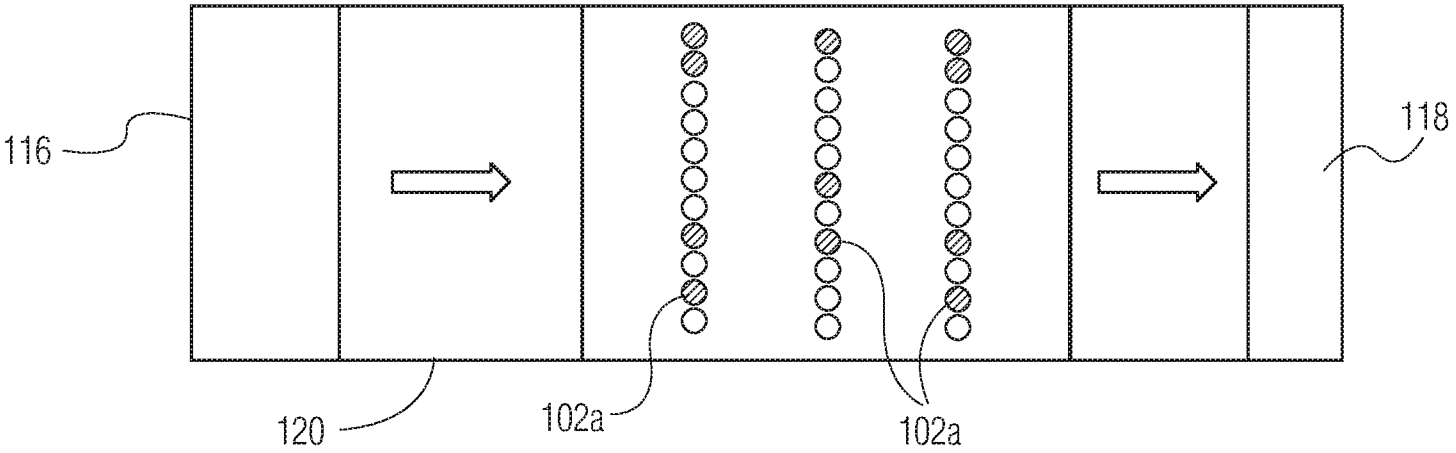

In FIGS. 4A-4B, system 10*a* is configured to form apertures in a flexible film 120 in a static configuration. More specifically, during each cycle of pressing to form apertures in flexible film 120, flexible film 120 is not in motion. In contrast, in FIGS. 5A-5B, system 10*b* (including the same basic elements as in system 10*a* of FIGS. 4A-4B) is configured to form apertures (e.g., see apertures 120*a* in FIGS. 7B-7C) in a flexible film 120 in a dynamic configuration. More specifically, during each cycle of pressing to form apertures 120*a* in flexible film 120, flexible film 120 is in motion (e.g., see two arrows pointing to the right in FIG. 5B, showing motion of flexible film 120).

Figure 6A:
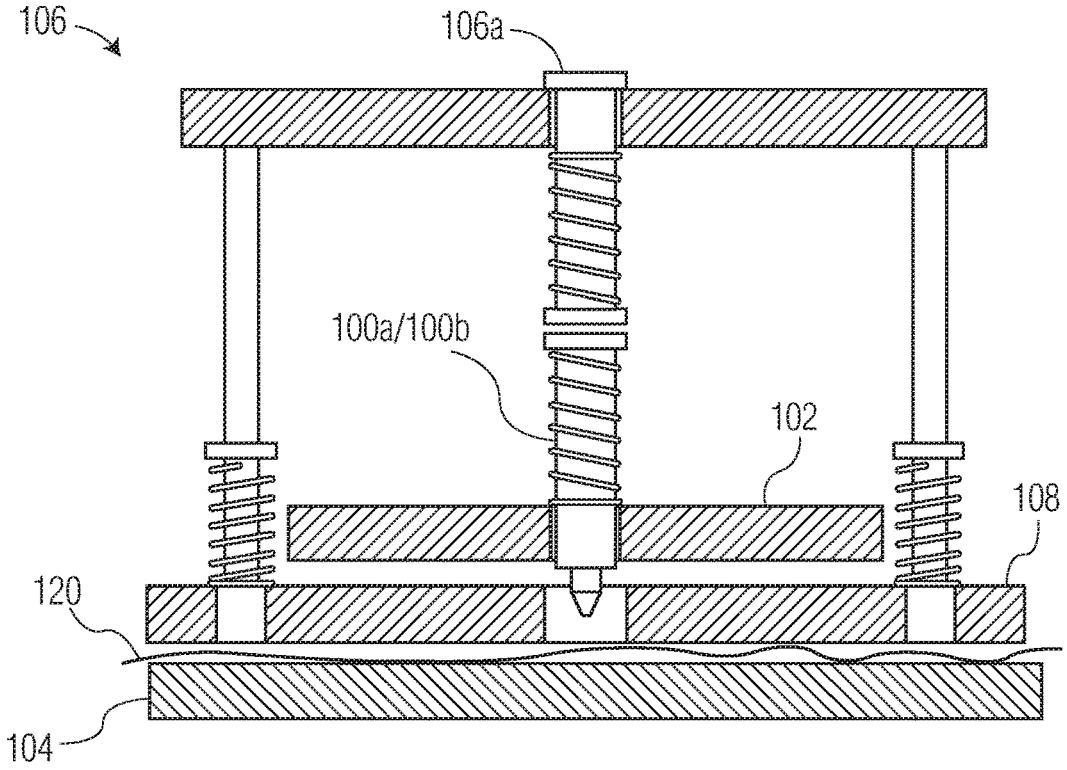
FIGS. 6A-6D are a series of block diagrams illustrating a method of forming a perforation/aperture in a flexible film in accordance with an exemplary embodiment of the invention.
Figure 6B:
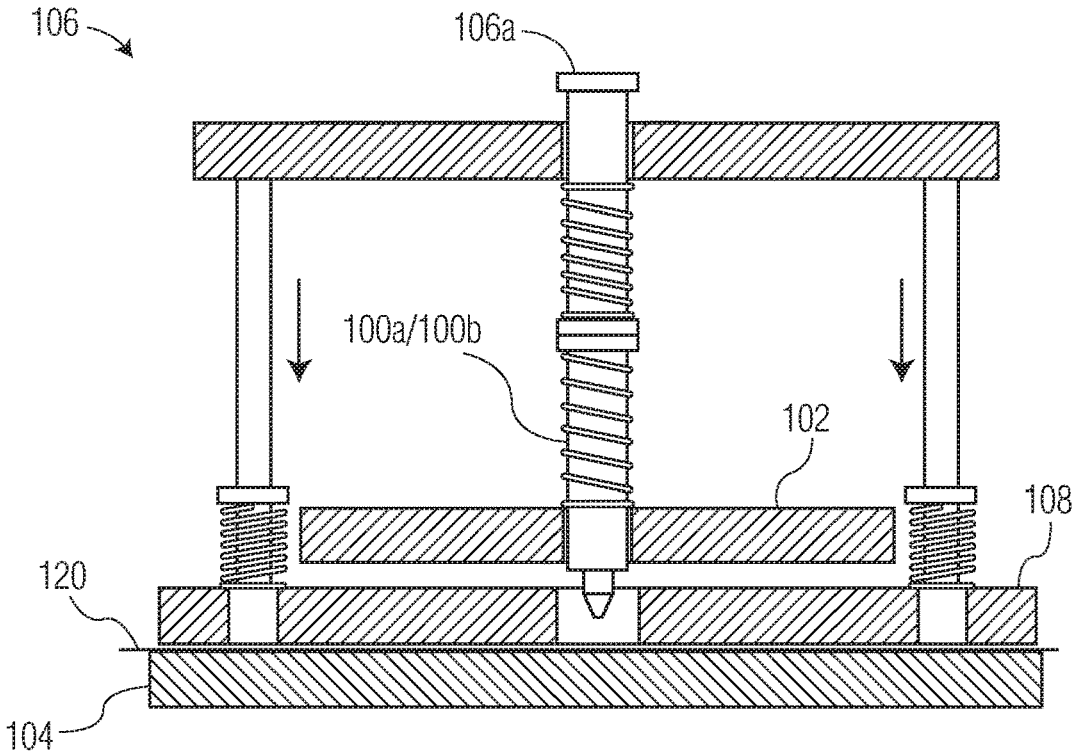
Figure 6C:
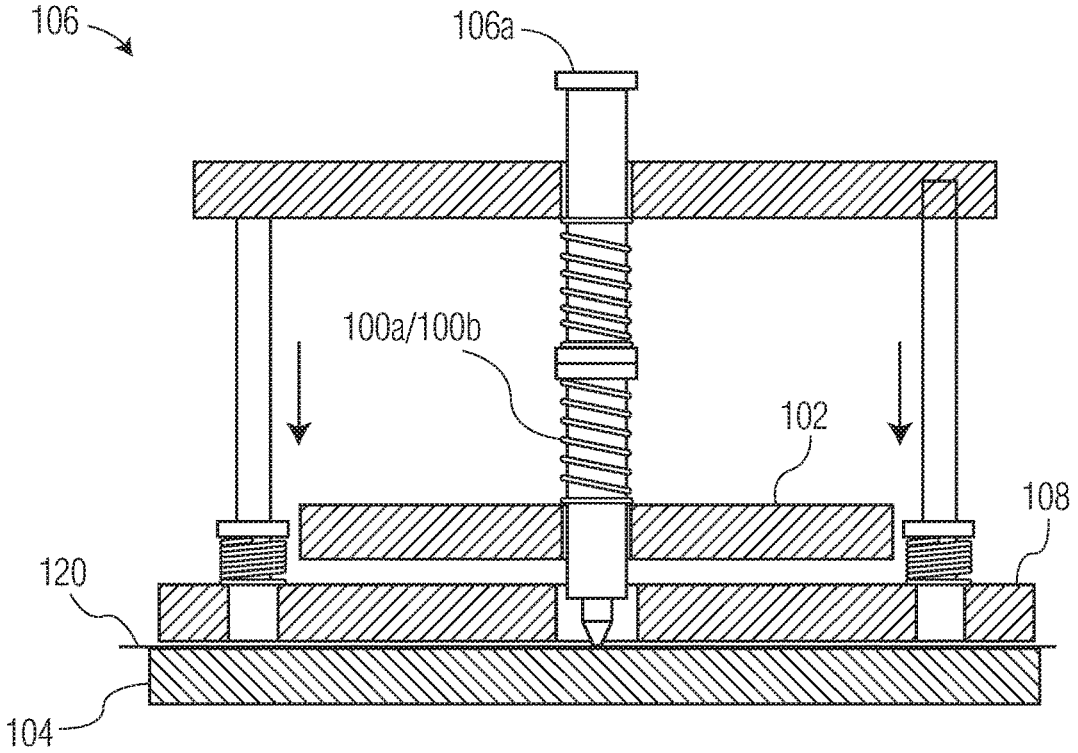
Figure 6D:
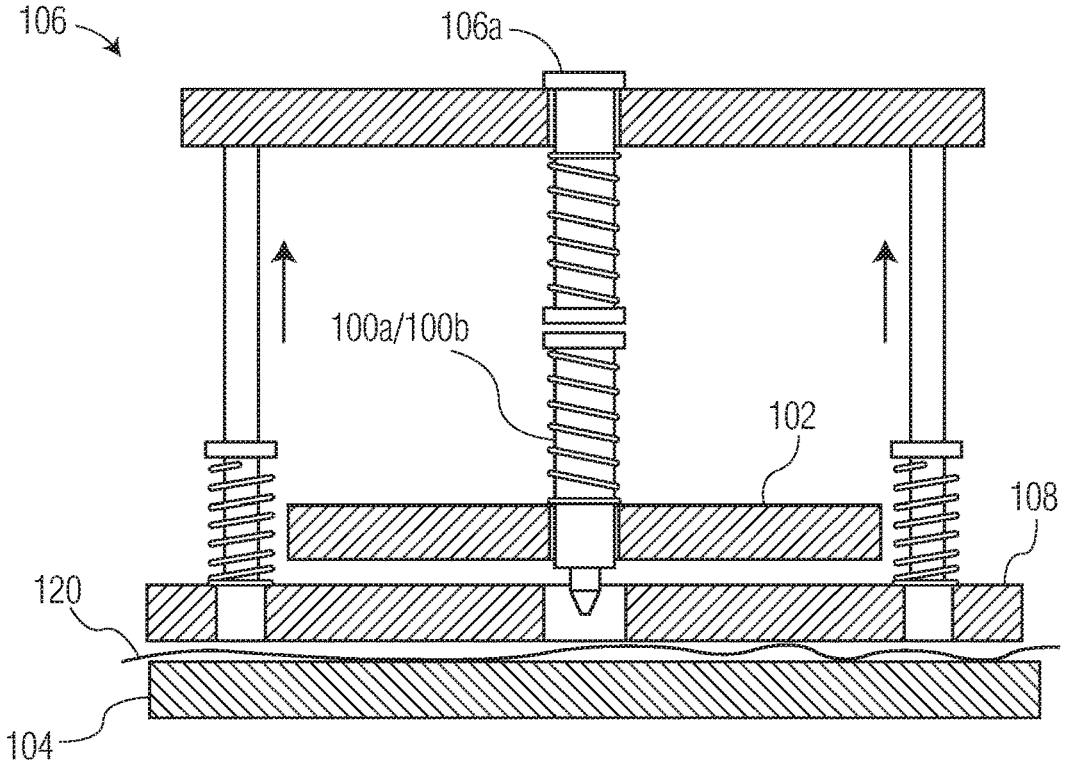

FIGS. 6A-6D are a series of block diagrams illustrating a method of forming a perforation in a flexible film. FIG. 6A illustrates the configuration before contact between striking member 106*a* and punching member 100*a*/100*b* (i.e., in FIGS. 6A-6D any punching member, such as punching member 100*a* or 100*b*, may be utilized). In FIG. 6B, striking member 106*a* (as part of striking tool 106) is lowered to contact punching member 100*a*/100*b*. As shown in FIG. 6B, the interconnection between striking tool 106 (which carries striking member 106*a*) and holding plate 108 results in the lowering of holding plate 108, and in holding plate 108 holding the flexible film 120 against support plate 104. In FIG. 6C, punching member 100*a*/100*b* has descended to form a perforation in flexible film 120 (detailed in FIGS. 7A-7C) via punching tool 100*b*1/100*b*2. In FIG. 6D, striking tool 106 (carrying striking member 106*a*) has been raised to restore the position of the elements of the system to their location in FIG. 6A. While FIGS. 6A-6D illustrate a single striking member 106*a* striking a single punching member 100*a*/100*b* to operate a single punching tool 100*b*1/100*b*2, it is understood that any number of striking members 106*a* (and punching members 100*a*/100*b* and punching tools 100*b*1/100*b*2) may be arranged in any number of columns and rows, and operated concurrently, to form a number of perforations in the flexible film 120.

Figure 7A:
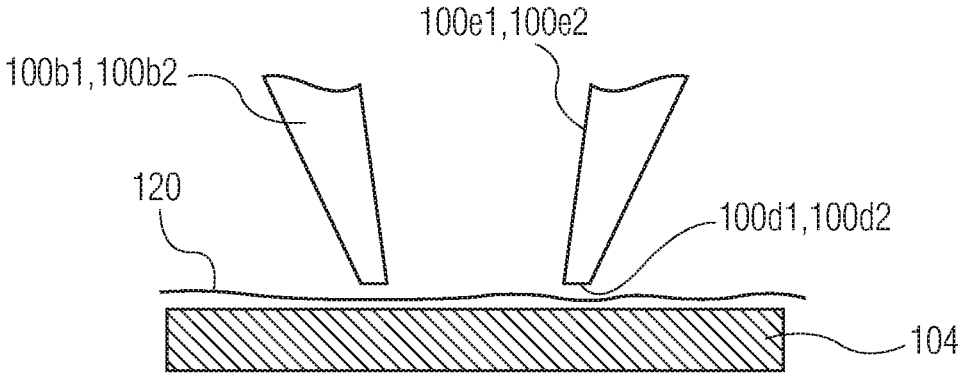
FIGS. 7A-7C are a series of enlarged, cross-sectional block diagrams of a working tip of a punching tool illustrating a method of forming a perforation/aperture in a flexible film in accordance with an exemplary embodiment of the invention.
Figure 7B:
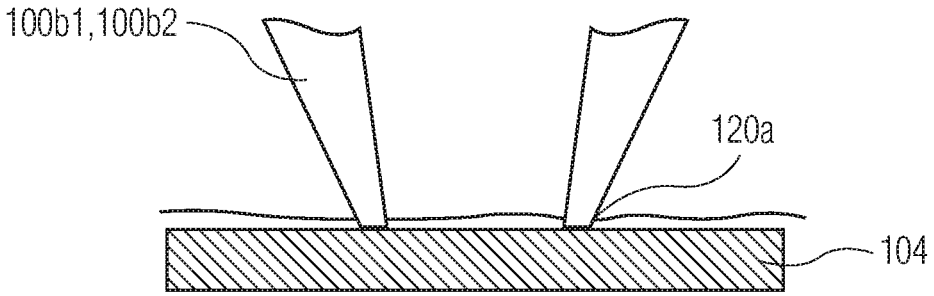
Figure 7C:
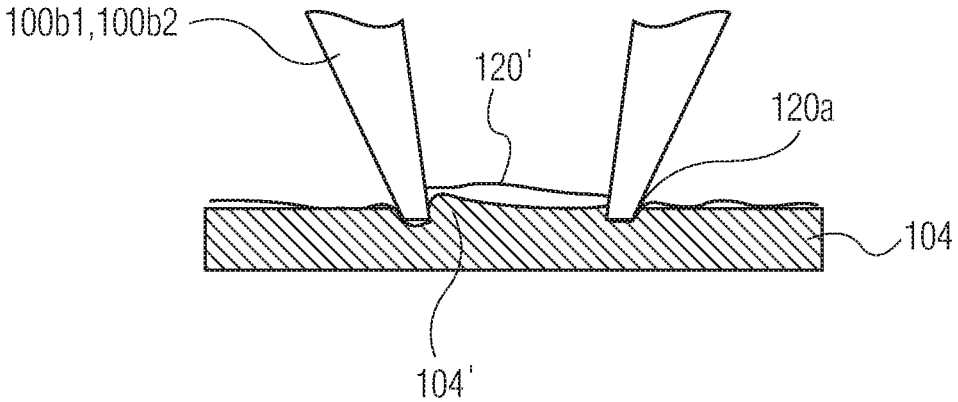

FIGS. 7A-7C are a series of block diagrams of a working tip 100*d*1, 100*d*2 of a punching tool 100*b*1, 100*b*2. That is, different types of punching tools (with different features) may be utilized. For simplicity, in FIGS. 7A-7C (and in other parts of the application), punching tools 100*b*1, 100*b*2 are shown. It is understood that if punching tool 100*b*1 is used, it will have working tip 100*d*1 as shown in FIG. 1A. Likewise, if punching tool 100*b*2 is used, it will have working tip 100*d*2 as shown in FIG. 1B. In FIG. 7A, working tip 100*d*1, 100*d*2 is approaching flexible film 120. In FIG. 7B, working tip 100*d*1, 100*d*2 has cut (or otherwise perforated) flexible film 120 to form an aperture 120*a* in flexible film 120. At least a portion of an upper surface of support plate 104 is formed of a compliant material (e.g., a rubber material, another compliant material, etc.) such that pressing of flexible film 120 against the upper surface using the punching tool results in deformation of the upper surface. The deformation of the upper surface results in formation of a shaped portion 104' of the upper surface adjacent through hole 100*e*1, 100*e*2 in punching tool 100*b*1, 100*b*2. The shaped portion 104' forces a cut portion 120' of flexible film 120 into through hole 100*e*1, 100*e*2 of punching tool 100*b*1, 100*b*2. This cut portion 120' may continue up further into through hole 100*e*1, 100*e*2 in connection with a cleaning system (e.g., see cleaning system 404 in FIGS. 4A-4B and FIGS. 5A-5B). For example, the cleaning system may simply be used to collect cut portions 120' in the through hole 100*e*1, 100*e*2 until they require removal. Further, a vacuum or other system may be utilized to remove the cut portions 120' from the through holes 100*e*1, 100*e*2, or from the system before entry into the through holes 100*e*1, 100*e*2. Further still, a different type of cleaning system may be utilized such as a brush based cleaning system for removing the cut portions 120' from the flexible film 120.

Figure 8A:
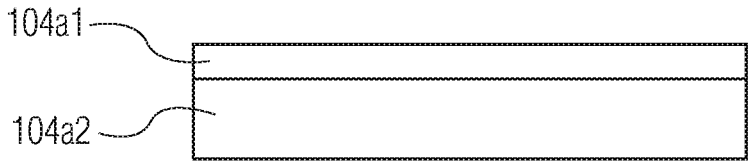
FIGS. 8A-8B are side and top block diagram views of a support plate in accordance with an exemplary embodiment of the invention.
Figure 8B:
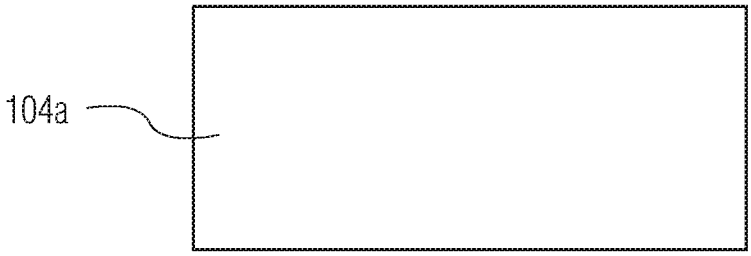

FIGS. 8A-8B, 9A-9B, and 10A-10B illustrates three (3) different examples of at least a portion of an upper surface of support plate 104 being formed of a compliant material. Each of FIGS. 4A-4B, 5A-5B, 6A-6D and FIGS. 7A-7C refer to a support plate 104. Examples of such a support plate 104 are shown in FIGS. 8A-8B (i.e., support plate 104*a*), FIGS. 9A-9B (i.e., support plate 104*b*), and FIGS. 10A-10B (i.e., support plate 104*c*). Any of these support plates, or others within the scope of the invention, may be support plate 104 of FIGS. 4A-4B, 5A-5B, 6A-6D and FIGS.

Figure 9A:
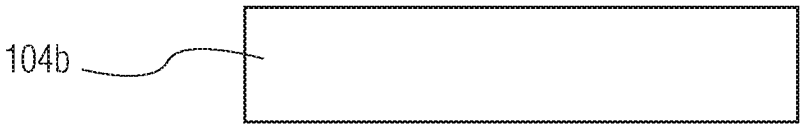
FIGS. 9A-9B are side and top block diagram views of another support plate in accordance with another exemplary embodiment of the invention.
Figure 9B:
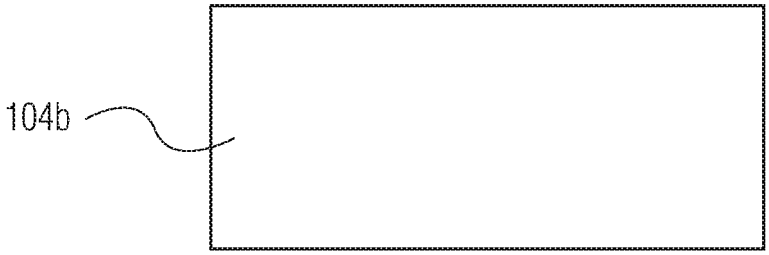
Figure 10A:
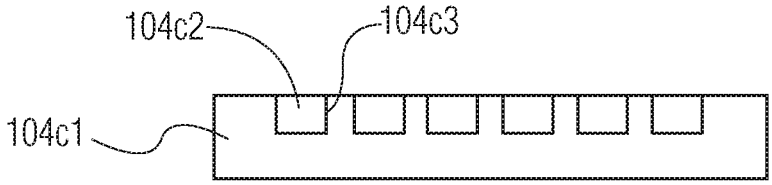
FIGS. 10A-10B are side and top block diagram views of yet another support plate in accordance with yet another exemplary embodiment of the invention.
Figure 10B:
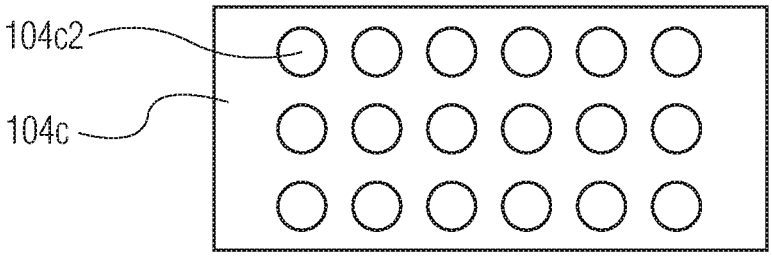

7A-7C. In FIGS. 8A-8B, a two layer support plate 104*a* is illustrated including an upper (compliant) layer 104*a*1 on a lower layer 104*a*2 (e.g., where the lower layer may be formed of a different, more rigid, material as compared to the upper layer) (e.g., where an exemplary material of the lower layer is steel). In FIGS. 9A-9B, a support plate 104*b* (formed of a unitary piece of material, such as a compliant material) is provided. In FIG. 10A-10B, compliant material inserts 104*c*2 are provided in base apertures 104*c*3 of base structure 104*c*1 (where compliant material inserts 104*c*2 align with punching tools 100*b*1, 100*b*2 which will press a flexible film against compliant material inserts 104*c*2 in connection with the formation of apertures 120*a*).

Apertures (e.g., perforations) 120*a* formed using the inventive systems and methods described herein may have improved characteristics such as uniformity, circularity, etc., particularly at small sizes. Exemplary ranges for the diameter of the apertures include: 45-150 microns; less than 200 microns; less than 150 microns; less than 100 microns; less than 75 microns; and less than 50 microns. Of course, larger apertures are also contemplated within the scope of the invention.

In accordance with certain exemplary embodiments of the invention, the working tip of the punching tool may be heated. The working tip may be heated through heat transfer between the working tip and: another portion of the punching tool, another portion of the punching member, and/or another portion of the system for forming the apertures.

Although the invention has been described and illustrated with respect to the exemplary embodiments thereof, it should be understood by those skilled in the art that the foregoing and various other changes, omissions and additions may be made therein and thereto, without parting from the spirit and scope of the present invention. Rather, various modifications may be made in the details within the scope and range of equivalents of the claims and without departing from the invention.

What is claimed:

1. A system for forming apertures in a flexible film, the system comprising:

a punching tool for forming apertures in a flexible film, the punching tool defining a through hole therethrough;

a support plate, the punching tool configured to press the flexible film against the support plate to form the apertures; and a tool holder for engagement with the punching tool, a portion of the punching tool being secured in an aperture defined by the tool holder, wherein the portion of the punching tool is secured within the aperture using at least one of an adhesive and a fastener.

2. The system of claim 1 wherein the punching tool is formed of a ceramic material.

3. The system of claim 1 wherein the punching tool has a cylindrical shape, and includes a tapered portion terminating at a working tip of the punching tool.

4. The system of claim 1 including a plurality of the punching tools configured to form a plurality of apertures in the flexible film concurrently.

5. The system of claim 1 wherein the tool holder is configured for motion in a vertical direction to press the punching tool against the flexible film.

6. The system of claim 5 wherein further comprising a spring member engaged with the punching tool such that the spring member is configured to compress during pressing of the flexible film against the support plate by the punching tool.

7. The system of claim 5 including a plurality of the punching tools configured to form a plurality of apertures in the flexible film concurrently, the plurality of the punching tools being held by the tool holder.

8. The system of claim 7 wherein the tool holder includes a plurality of receivers, each of the plurality of receivers being available to receive one of the plurality of the punching tools.

9. The system of claim 1 further comprising a striking tool, the striking tool being configured to strike against the punching tool such that the punching tool presses the flexible film against the support plate to form the apertures.

10. The system of claim 9 wherein the tool holder is configured for holding a plurality of the punching tools, the tool holder being configured for motion in a vertical direction to press the punching tool against the flexible film.

11. The system of claim 9 wherein the striking tool includes a plurality of striking members, each of the striking members being aligned to strike against a corresponding one of the plurality of punching tools.

12. The system of claim 1 wherein a working tip of the punching tool is heated.

13. The system of claim 1 further comprising a holding plate for holding the flexible film against the support plate, the holding plate defining a hole through which a working tip of the punching tool extends during pressing of the flexible film against the support plate by the punching tool.

14. The system of claim 1 wherein the through hole defined by the punching tool is configured to receive a cut portion of the flexible film caused by forming the apertures.

15. The system of claim 1 further comprising a cleaning system for collecting cut portions of the flexible film caused by forming the apertures.

16. The system of claim 1 further comprising a feed system for moving the flexible film.

17. The system of claim 16 wherein the feed system includes a source spool of the flexible film and a downstream spool for receiving the flexible film from the source spool.

18. The system of claim 1 wherein the flexible film is in motion during formation of the apertures using the punching tool.

19. The system of claim 1 wherein the flexible film is stationary during formation of the apertures using the punching tool.

20. The system of claim 1 including a plurality of the punching tools configured to form a plurality of apertures in the flexible film concurrently, the plurality of punching tools including at least two different types of punching tools.

21. The system of claim 20 wherein the two different types of punching tools have different diameters at their respective working tip.

22. The system of claim 1 further comprising a control system for controlling operation of the system including controlling the punching tool pressing the flexible film against the support plate to form the apertures.

23. The system of claim 1 further comprising an inspection system for inspecting the apertures formed using the punching tool.

24. The system of claim 1 wherein the tool holder is configured for motion in a vertical direction to press the punching tool against the flexible film, the tool holder including a receiver configured to receive a portion of the punching tool.

* * * * *